US006302996B1

(12) United States Patent
Juutinen

(10) Patent No.: US 6,302,996 B1
(45) Date of Patent: Oct. 16, 2001

(54) METHOD AND APPARATUS FOR WASHING FIBER PULP MIXTURE

(75) Inventor: Vesa Juutinen, Tampere (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/621,225

(22) Filed: Jul. 21, 2000

(30) Foreign Application Priority Data

Jul. 22, 1999 (FI) ..... 991641

(51) Int. Cl.[7] ..... D21C 7/14; D21C 9/02; D21C 1/01

(52) U.S. Cl. ..... 162/60; 162/49; 8/156

(58) Field of Search ..... 162/4, 55, 56, 162/60, 190, 301, 318, 390, 189, 49, 48, 300; 210/386, 391, 401, 402, 770, 783; 8/156; 68/45

(56) References Cited

U.S. PATENT DOCUMENTS

| | | | | |
|---|---|---|---|---|
| 4,501,040 | | 2/1985 | Biondetti et al. . | |
| 5,196,090 | * | 3/1993 | Corbellini et al. | 162/190 |
| 5,257,438 | * | 11/1993 | Fass et al. | 19/145.5 |

FOREIGN PATENT DOCUMENTS

| | | |
|---|---|---|
| 0 162 179 A1 | 11/1985 | (EP) . |
| 0 488 058 A1 | 6/1992 | (EP) . |
| WO 96/09433 A1 | 3/1996 | (WO) . |

OTHER PUBLICATIONS

Tappi, Test Method T211 om–93, "Ash in Wood, Pulp, Paper, and Paperboard: Combustion at 525 Degrees C" (abstract only from www.tappi.org).*

Tappi, Test Method T261 cm–00, "Fines Fraction by Weight of Paper Stock by Wet Screening" (abstract only from www.tappi.org).*

Tappi, Test Method T413 om–93, "Ash in Wood, Pulp, Paper, and Paperboard: Combustion at 900 Degrees C" (abstract only from www.tappi.org).*

PCT International Search Report, PCT/F100/00658, completed Nov. 27, 2000.

* cited by examiner

*Primary Examiner*—Peter Chin
*Assistant Examiner*—Eric Hug
(74) *Attorney, Agent, or Firm*—Alston & Bird LLP

(57) ABSTRACT

The invention relates to a method of washing a fiber pulp mixture, in which method the fiber pulp mixture is fed between two filter wires running in the same direction. There is a convergent dewatering space in the direction of travel of the wires, where water is removed from the pulp. According to the idea of the invention, the thickness of the pulp layer being fed between the wires is adjusted during operation, since the ash and fines content of the washed fiber pulp is essentially dependent on the basis weight of the fiber web being washed. In a preferred embodiment of the invention, the height of the slice at the output end of the dewatering space is adjusted. The essential idea of another preferred embodiment of the invention is that the speed of the wires is adjusted. The invention also relates to an arrangement comprising means for adjusting the thickness of the pulp layer being fed between the wires, i.e. the basis weight of the fiber web being washed.

13 Claims, 1 Drawing Sheet

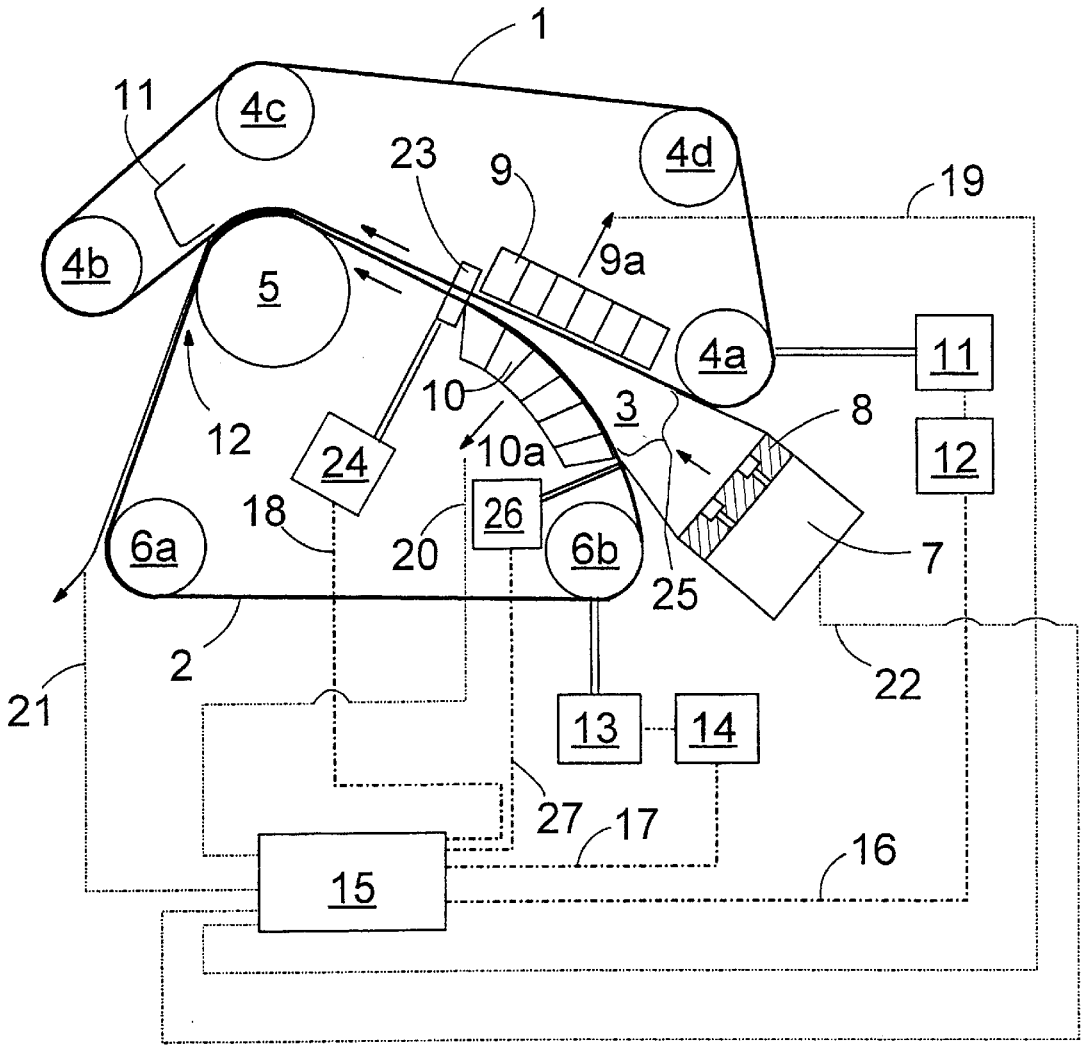
FIG.

METHOD AND APPARATUS FOR WASHING FIBER PULP MIXTURE

FIELD OF THE INVENTION

The invention relates to a method of washing a fiber pulp mixture, in which method a fiber pulp mixture which is substantially constant in consistency is fed between two filter wires running in the same direction, at a substantially constant input flow, the wires being run into a closed dewatering space which converges in their direction of travel, whereby the filter wires support themselves on to surfaces equipped with dewatering holes, and water is removed from the fiber pulp mixture through the wires and the surfaces of the dewatering space, after which the washed fiber pulp mixture exits, supported by the wires, the dewatering space through a slice at its output end.

The invention also relates to an arrangement for washing a fiber pulp mixture, which arrangement comprises two water permeable filter wires arranged to run in the same direction, the wires being run into a closed dewatering space which converges in their direction of travel, in which dewatering space the filter wires are arranged to support themselves against surfaces equipped with dewatering holes, and means for feeding the fiber pulp mixture between the wires, whereby the water in the fiber pulp mixture is arranged to drain through the wires and the surfaces of the dewatering space and whereby the washed fiber pulp is arranged to exit, supported by the wires, the dewatering space through a slice at its output end.

BACKGROUND OF THE INVENTION

Fiber pulp, such as waste fiber, contains not only fiber-like raw materials, but also filling agents, such as ash and also fines originating from the fiber-like material. To be able to reuse such a fiber pulp in paper-making, it needs to be washed in a de-inking plant. There, a certain part of the fine fraction of the fiber pulp is removed by means of water, and the aim is to leave only useful fibers in the pulp. Thus, ash and other particle-like materials, for instance, are washed away by means of filtrate waters. Further, when washing fiber pulp, water is removed from it with the aim of affecting the consistency of the washed pulp. The washed accept is led on in the process to be used as raw material for newsprint and soft tissue, for instance.

There are several different apparatuses on the market for the above-mentioned pulp washing. The known apparatuses remove fines relatively well. The problem is, however, that fines loss cannot be adjusted during operation in the present apparatuses, and such an adjustment always requires a shutdown. When process conditions change, the apparatus is stopped and washing is changed by changing the wires, for instance. A further problem may be that when attempting maximum ash removal, fines loss becomes too high, which is uneconomical with respect to efficient use of the pulp. Changes in the process impair the running of the washers, producing a varying washing result which then causes problems in the phases after the washers.

The object of this invention is to provide a method and an arrangement which prevent the problems occurring in prior art solutions.

SUMMARY OF THE INVENTION

The method of the invention is characterized in that the thickness, i.e. pulp weight per surface area, of the fiber pulp layer being fed between the wires is adjusted during operation, whereby the ash and fines content of the washed fiber pulp can be adjusted to desired values.

Further, the arrangement of the invention is characterized in that the arrangement comprises means for adjusting during operation the layer thickness of the fiber pulp mixture being fed between the wires, to adjust the ash and fines content of the washed fiber pulp to desired values.

The essential idea of the invention is that the fiber pulp is fed between two wires which are arranged to run towards a slice at the output end of a convergent dewatering space. In the dewatering space, liquid in the pulp drains through the wires and further through the holed surfaces of the dewatering space. Fiber pulp is fed into the apparatus substantially at a constant flow. According to the idea of the invention, the grammage of the fiber pulp being fed between the wires, i.e. the thickness of the pulp layer running between the wires during washing, is adjusted. Ash removal ability is essentially dependent on the thickness of the fiber web being washed. Further, the essential idea of a preferred embodiment of the invention is that the grammage of the fiber pulp being fed between the wires is adjusted by adjusting the height of the slice, i.e. the quantity of the fiber pulp being fed between the wires. The idea of a second preferred embodiment of the invention is that the speed of the wires, i.e. the running speed of the washer, is adjusted. Another essential idea is that the layer thickness of the pulp being fed in is adjusted on the basis of the ash and fines content measured from the washed fiber pulp, the fiber mixture fed between the wires and/or the removed water.

The invention provides the advantage that this way it is possible to adjust the ash and fines content of the washed fiber material to be suitable for each use. Large quantities of waste fiber are used in newsprint and soft tissue, for instance, and the requirements for their ash and fines content are different. Soft tissue requires maximum ash removal, whereas newsprint does not require complete ash removal, but a certain level with which the desired strength and other technical properties can be achieved. With the solution of the invention, it is possible to exactly adjust the ash content. It is then possible to manufacture pulp having different fines contents simply and quickly in the same apparatus without complex changing of settings and wires. In pulp of this kind, the relative proportion of ash and fines in the washed fiber pulp, and correspondingly the proportion of other fibers, is as desired. Thus, the same kind of apparatus can be used in various factories, as the paper and process engineering properties of the washed pulp can always be tuned as required by each factory. Further, other processes of the factory can be kept as they are or the processes can be adjusted quite freely independent of the washing. In addition, the solution of the invention is more environment-friendly than before, because ash and other fines are not unnecessarily washed from the pulp. This means that smaller quantities of fines find their way outside the process with filtrate waters. Because the washing is, due to the adjustment, done at exactly the right efficiency, the power consumption of washing is smaller than before. This matter is naturally significant for both the environment and the price of the final product. Further, the process becomes more stable and easier to run due to measurements and the adjustments made on the basis thereof, whereby a fiber pulp having a more even quality exits the washer for the following phases of production. This way, process variations occurring during the phases prior to washing and sudden peaks caused by process disturbances can also be evened out. Owing to the adjustment according to the invention, the washing can be adjusted without needing to change the flow or the consistency of the pulp being fed into the washer. Thus, the washing does not require changes in the prior process phases and expensive additional equipment.

BRIEF DESCRIPTION OF THE FIGURE

The invention is described in greater detail in the attached drawing which shows a schematic sectional side view of the principle of a washing apparatus of the invention.

DETAILED DESCRIPTION OF THE PREFERRED EMBODIMENTS

The apparatus comprises a first wire 1 and a second wire 2 having a dewatering space 3 between them. The first wire 1 rotates in a closed loop around guide rolls 4*a* to 4*d* and the second wire 2 correspondingly around a turning roll 5 and guide rolls 6*a* and 6*b*. The number and location of guide rolls can be as deemed suitable, which matter is known per se and obvious to a person skilled in the art. The fiber pulp mixture to be washed is fed into a feeding chamber 7 from which it is preferably fed through for instance a turbulence generator 8 known per se to the dewatering space 3 between the first wire 1 and the second wire 2. On both sides of the dewatering space 3 against the outer surface of the wires 1 and 2, there are dewatering boxes 9, 10 or the like, through which water in the fiber pulp mixture in the dewatering space 3 is drained as shown by arrows 9*a* and 10*a*. The dewatering space 3 is most preferably a closed chamber formed by sides and support structures between the sides along which the wires 1 and 2 run through the dewatering chamber. The dewatering boxes 9, 10 or the like are installed on the support structures in such a manner that the water drained through the wires flows through the support structures to the dewatering boxes or the like. Such wire support structures, which may be made of a perforated plate, various foil structures or the like, are known to a person skilled in the art and they or their operation need, therefore, not be explained in more detail.

In this application and its claims, a closed dewatering chamber refers specifically to a structure where fiber pulp and the water contained in it can only exit the dewatering space along desired dewatering routes.

Since both sides of the dewatering space are closed and the wires 1 and 2 are made tight beside the guide rolls 4*a* and 6*b* in such a manner that the fiber pulp mixture cannot escape elsewhere, the fiber pulp mixture has to flow from the dewatering space 3 onward in the same direction as the wires 1 and 2. At the same time, water drains continuously from it. Dewatering in a dewatering space occurs, for instance, in such a manner that water is drained in the forward end of the dewatering space 3, i.e. in the input end of the fiber pulp, preferably more in proportion to the travel length of the fiber pulp than at the output end of the dewatering space 3. A turbulence formed in advance in the fiber pulp mixture can also be maintained by adjusting the dewatering on the basis of the speed ratio difference, and the fibers remain suitably mixed without a significant filtering onto the surfaces of the wires 1 and 2 taking place. When the fiber pulp mixture arrives at the turning roll 5, water still drains from it, due to the centrifugal force and the tightness of the wires, upwards through the wire 1 to a dewatering tray 11, whereby a fiber pulp having a suitable dry stuff content may be achieved as a result. Because the consistency of the fiber pulp mixture coming out of the dewatering space 3 is quite high, the fiber pulp mixture remains between the wires 1 and 2 without trying to gush out from the side. Thus, this apparatus does not require separate sealings after the dewatering space. To make the fiber pulp follow the lower wire 2 requires a force affecting into said direction. This is preferably achieved by using a smooth turning roll 5. Thus a negative pressure is formed in the space, marked 12 in the figure, between the wire 2 and the turning roll 5 on the left side of the turning roll 5 when the wire 2 separates from the roll. This, for its part, causes the negative pressure to suck the fiber pulp against the wire 2 and consequently, the fiber pulp is separated from the top wire 1.

For clarity's sake, a slice 23 at the output end of the dewatering space 3 is drawn in a highly simplified manner in the figure. The slice comprises a top lip and a lower lip, whose operation is known per se to a person skilled in the art. According to the idea of the invention, the size, i.e. height, of the slice 23 can be adjusted by means of suitable actuators 24. Adjustable mechanical limiters, against which the top and lower lip can be set during operation, can also be installed to the slice. This adjustment of the slice makes it possible to control the dry stuff content of the fiber pulp exiting the apparatus as desired. The slice of the present washing apparatuses cannot be adjusted during operation.

The figure also shows the input opening of the apparatus, marked in the figure schematically with a round bracket 25, and a second actuator 26 for adjusting the height of the input opening of the apparatus by means of an operating coupling 27. In the figure, the actuator 26 is marked to control the height of the input opening on the side of the lower lip only, but a similar actuator can correspondingly be connected to the side of the top lip so that both can preferably symmetrically be adjusted simultaneously in relation to the input channel of the fiber pulp flow. Similarly, it is possible to use only one input opening actuator 26 which is connected to adjust both lips simultaneously in the same way as the actuator 24. By adjusting the height of the input opening, it is possible to correspondingly adjust the ash wash and the basis weight of the washed pulp. Adjusting the height of the input opening makes it possible to change the discharge rate of the fiber pulp being washed in relation to the wires. Thus, when reducing the height of the input opening, the flow rate of the fiber pulp increases in relation to the wires, and correspondingly, when widening the input opening, the flow rate of the fiber pulp decreases in relation to the wires and speed. In the currently used apparatuses, the discharge of the fiber pulp being fed between the wires is adjusted according to the speed of the wires, and their relation with respect to each other, and consequently, the basis weight of the fiber pulp, cannot be adjusted.

The figure also shows drive units 11 and 13 arranged with the rolls 4*a* and 6*b*, which units run said rolls by means of suitable shafts, gears and other necessary power transmission equipment to move the wires 1 and 2. The drive units are preferably electric motors whose speed can exactly and preferably steplessly be adjusted by means of frequency converters or corresponding regulating units 12, 14. Moving the wires can naturally also be arranged by using another roll.

The apparatus also comprises a control unit 15 which is arranged to control the above-mentioned regulating units 12 and 14 of the drive units 11 and 13 by means of operating couplings 16 and 17 and/or the actuator 24 of the slice 23 by means of an operating coupling 18.

The operating couplings are marked by a thicker dotted line in the figure. Measuring connections 19 to 22 are marked by a lighter dotted line in the figure. The ash and fines content of the filtrate waters exiting the dewatering space 3 are measured and the measurement data is forwarded by means of the measuring connections 19 and 20 to the control unit 15. It is also possible to measure the ash and fines content of the fiber pulp being fed from the feeding chamber 7 and to forward the obtained measurement data to the control unit by means of the measurement connection 22. It is further possible to adjust the washing on the basis of the properties of the washed fiber pulp. The measurement result obtained on the ash and fines content of the washed pulp is then forwarded by means of the measurement connection 21 to the control unit. Making measurements on waters is usually easier than on accept. The measuring devices suitable for the purpose are known to a person skilled in the art and need thus not be presented herein. The control unit can be a computer, for instance, or another suitable control device, such as a programmable logic. It should be noted that, for adjustment, it is possible to measure either only one of the above parameters or alternatively all of them at the same time. Similarly, it is possible to have the control unit control the speed of the wires and the slice simultaneously, in which case the washing result can be affected by adjusting the relation between the running speed and the slice size.

Tests made on the apparatus show that increasing the feed consistency reduces ash removal and fines loss in the washed pulp. In addition, it reduces power consumption and, naturally, increases the consistency of the washed pulp. Increasing wire speed reduces ash and fines removal as well as power consumption. A change in wire speed does not seem to affect the consistency of the washed pulp. In principle, it should be possible to adjust the washing result by changing the consistency of the fiber mixture fed into the apparatus, but in most cases, the process is run in factories at a standard consistency, and the factories do not have equipment for adjusting the consistency, which means that a dilution water cycle or a corresponding apparatus would have to be build separately for this purpose. If such an adjustment option exists, however, it can be used so that when a careful fines-saving wash is required, the feed consistency is increased, and correspondingly, when a strong wash is required, the feed consistency is reduced.

Wire speed can in normal use be adjusted in the speed range below 500 m/min. When a gentle wash is required, i.e. a wash that washes away less fines particles of the pulp, wire speed is set to correspond to the rate of the slice discharge. The rate of the slice discharge can even be set higher than wire speed. When an efficient fines wash is required, i.e. when a strong wash/high fines loss is required, wire speed is set considerably higher than the rate of the slice discharge (250 m/min, for instance). The thickness of the pulp layer is then smaller and fines are efficiently washed away from the thin layer.

The drawing and the related description is only intended to illustrate the idea of the invention. The invention may vary in detail within the scope of the claims. Actuators used as the means for controlling the slice and input opening include pressure intermediate agent cylinder or a combination of a motor and gears.

What is claimed is:

1. A method of washing a fiber pulp mixture having a substantially constant consistency, said method comprising:

feeding the fiber pulp mixture at a substantially constant volumetric input flow between two filter wires running in the same direction;

advancing the filter wires into a closed dewatering space which converges in the direction of travel of the wires;

advancing the filter wires past at least one surface equipped with dewatering holes so that water is removed from the fiber pulp mixture through the wires and the surfaces;

advancing the filter wires supporting the washed fiber pulp mixture through a slice at an output end of the dewatering space; and adjusting the thickness of the fiber pulp layer in terms of pulp weight per surface area ratio when the fiber pulp mixture is between the filter wires such that the ash and fines content of the washed fiber pulp can be adjusted to desired values.

2. A method as claimed in claim 1 wherein said adjusting step comprises adjusting the height of an input opening to the dewatering space such that the quantity of the fiber pulp mixture flowing into the dewatering space is adjusted.

3. A method as claimed in claim 1, wherein said adjusting step comprises adjusting the speed of the filter wires.

4. A method as claimed in claim 1, comprising the further steps of measuring the ash and fines content of the washed fiber pulp and using the measurement result in adjusting the fiber pulp weight per surface area ratio.

5. A method as claimed claim 1, comprising the further steps of measuring the ash and fines content of the fiber pulp mixture being fed and using the measurement result in adjusting the fiber pulp weight per surface area ratio.

6. A method as claimed in claim 1, comprising the further steps of measuring the ash and fines content of the water drained from the fiber pulp mixture and using the measurement result in adjusting the fiber pulp weight per surface area ratio.

7. An arrangement for washing a fiber pulp mixture, said arrangement comprising:

two water permeable filter wires arranged to run in the same direction, the wires being run into a closed dewatering space which converges in the direction of travel of the wires;

at least one support surface past which the filter wires are advanced, said surface defining dewatering holes therein;

a feeding chamber for feeding the fiber pulp mixture between the wires, wherein at least part of the water in the fiber pulp mixture is arranged to drain through the wires and the support surface of the dewatering space;

a slice at an output end of the dewatering space through which the washed fiber pulp is arranged to exit while on the filter wires; and means for adjusting the thickness of the fiber pulp layer in terms of pulp weight per surface area ratio as the fiber pulp mixture is between the wires to adjust the ash and fines content of the washed fiber pulp to desired values.

8. An arrangement as claimed in claim 7, wherein said dewatering space defines an input opening, said input opening being adjustable in size so as to adjust the quantity of fiber pulp mixture being fed between the wires.

9. An arrangement as claimed in claim 7, wherein the speed of the filter wires is capable of being adjusted.

10. An arrangement as claimed in claim 9, further comprising at least one electric motor for driving the filter wires and at least one frequency converter for controlling the electric motor and thus also controlling the speed of the wires.

11. An arrangement as claimed in claim 7, further comprising at least one measuring device for measuring the ash and fines content of the washed fiber pulp to allow adjustment of the fiber pulp weight per surface area ratio.

12. An arrangement as claimed in claim 7, further comprising at least one measuring device for measuring the ash and fines content of the fiber pulp mixture being fed to allow adjustment of the fiber pulp weight per surface area ratio.

13. An arrangement as claimed in claim 7, further comprising at least one measuring device for measuring the ash and fines content of the water drained from the fiber pulp mixture to allow adjustment of the fiber pulp weight per surface area ratio.

* * * * *